US009622584B2

(12) United States Patent
Eicke

(10) Patent No.: US 9,622,584 B2
(45) Date of Patent: Apr. 18, 2017

(54) PORTABLE CHAIR

(71) Applicant: Max ID NY LLC, Sag Harbor, NY (US)

(72) Inventor: Maximilian M Eicke, Sag Harbor, NY (US)

(73) Assignee: MAX ID NY LLC, Sag Harbor, NY (US)

( * ) Notice: Subject to any disclaimer, the term of this patent is extended or adjusted under 35 U.S.C. 154(b) by 279 days.

(21) Appl. No.: 14/332,437

(22) Filed: Jul. 16, 2014

(65) Prior Publication Data

US 2015/0021960 A1 Jan. 22, 2015

Related U.S. Application Data

(60) Provisional application No. 61/856,257, filed on Jul. 19, 2013.

(51) Int. Cl.

| | |
|---|---|
| ***A47C 7/02*** | (2006.01) |
| ***A47C 3/04*** | (2006.01) |
| ***A47C 4/04*** | (2006.01) |
| ***A47C 1/14*** | (2006.01) |
| ***A47C 5/10*** | (2006.01) |

(52) U.S. Cl.

CPC ..... *A47C 7/02* (2013.01); *A47C 1/143* (2013.01); *A47C 3/04* (2013.01); *A47C 4/04* (2013.01); *A47C 5/10* (2013.01)

(58) Field of Classification Search

None

See application file for complete search history.

(56) References Cited

U.S. PATENT DOCUMENTS

| | | | | | |
|---|---|---|---|---|---|
| 2,728,376 | A | | 11/1954 | Halde | |
| 3,342,294 | A | | 9/1967 | Beatty | |
| 3,847,433 | A | * | 11/1974 | Acton | A47C 1/124 297/239 |
| 4,010,978 | A | * | 3/1977 | Rosen | A47C 3/04 297/239 |
| 4,359,245 | A | * | 11/1982 | Franke | A61G 5/14 297/284.1 |
| D399,353 | S | * | 10/1998 | Krass | D12/128 |
| 6,254,177 | B1 | * | 7/2001 | Tseng | A47C 4/10 108/125 |
| D668,470 | S | | 10/2012 | Eicke | |
| D738,656 | S | * | 9/2015 | Parisi | D6/375 |
| 2006/0108839 | A1 | | 5/2006 | Liu | |
| 2007/0135740 | A1 | * | 6/2007 | Butler | A61H 23/0236 601/47 |

(Continued)

FOREIGN PATENT DOCUMENTS

| | | | | | |
|---|---|---|---|---|---|
| CN | WO 2011147087 | A1 | * | 12/2011 | A47C 4/04 |
| DE | 19835170 | A1 | * | 2/2000 | A47B 96/202 |

*Primary Examiner* — David E Allred

(74) *Attorney, Agent, or Firm* — Hoffman & Baron, LLP

(57) ABSTRACT

A portable chair includes an undulating wave-shaped body. The undulating wave-shaped body has a convex lower portion which transitions into a concave mid-section, which in turn transitions into a convex upper portion. The chair further includes a support leg pivotally attached to the body and being movable between a closed position for storage and carrying and an open position for seating. The support leg is concave shaped to substantially conform to the shape of the concave mid-section of the body when in the closed position.

12 Claims, 13 Drawing Sheets

(56) References Cited

U.S. PATENT DOCUMENTS

| | | | | |
|---|---|---|---|---|
| 2008/0238156 | A1* | 10/2008 | Miyakawa | A47B 85/06 297/19 |
| 2009/0038071 | A1* | 2/2009 | Bass | A45F 3/22 5/120 |
| 2015/0015036 | A1* | 1/2015 | Soriano | A47D 13/102 297/217.4 |
| 2015/0150374 | A1* | 6/2015 | Jones | A47C 1/143 297/135 |

* cited by examiner

PORTABLE CHAIR

FIELD OF THE INVENTION

The invention relates to a portable chair, and more particularly relates to a chair which is easy to carry and stackable, such as a beach or pool chair.

BACKGROUND

Beach and pool chairs which are foldable and/or stackable are well known. For example, framed beach chairs which fold for storage and carrying such as that shown in U.S. Pat. No. 6,113,181 have been available for many years. However, these types of chairs are typically bulky and difficult to carry. Furthermore, these types of chairs are not very stylish or aesthetically pleasing.

OBJECTS AND SUMMARY

The present invention overcomes the shortcomings described above by providing a compact, easy to transport, stylish, portable chair.

It is an object of the invention to make a compact, lightweight, portable chair.

It is a further object of the invention to provide a chair which is comfortable for use by persons of many different body sizes, including adults and children.

It is still a further object of the invention to provide a portable chair which, when in the storage or closed position, is stackable.

It is a further object of the invention to provide a portable chair which is unique in shape and appearance to be instantly recognizable by the purchasing public.

The chair of the present invention achieves these objects by providing a uniquely shaped chair having a body portion which is compact and easy to carry. Furthermore, the chair of the present invention is aesthetically pleasing and stylish having a body in the form of an undulating wave shape.

More specifically, the portable chair of the present invention includes an undulating wave-shaped body having a lower portion which includes a ground-contacting surface. The chair further includes a support leg having an upper portion pivotally attached to the body and movable between a closed position and an open position. The support leg is preferably concave-shaped to conform to the shape of the body when in the closed position. When in the open position, a lower portion of the support leg provides a ground contacting surface. The chair preferably also includes at least one cable having one end mounted to a lower portion of the support leg and the other end mounted to the body to maintain the support leg in the open position.

The undulating wave-shaped body preferably includes a convex lower portion, a concave mid-section and a convex upper portion. The body and support leg may be formed using a frame, such as tubular aluminum, covered with a plastic weaving or other suitable material known to those skill in the art. Alternatively, the body and support leg may be molded from plastic, for example, by injection molding.

To make the chair easy to carry, handles are provided on the concave mid-section. When the user is carrying the chair, the concave mid-section wraps around the user's body making transport of the chair easy. Thus, the curve of the chair hugs the carrier's body without causing the chair to hit the carrier's legs.

BRIEF DESCRIPTION OF THE DRAWINGS

These and other features of the present invention will be more clearly understood from consideration of the following description, taken in connection with the accompanying drawings, in which.

DETAILED DESCRIPTION

Figure 1:
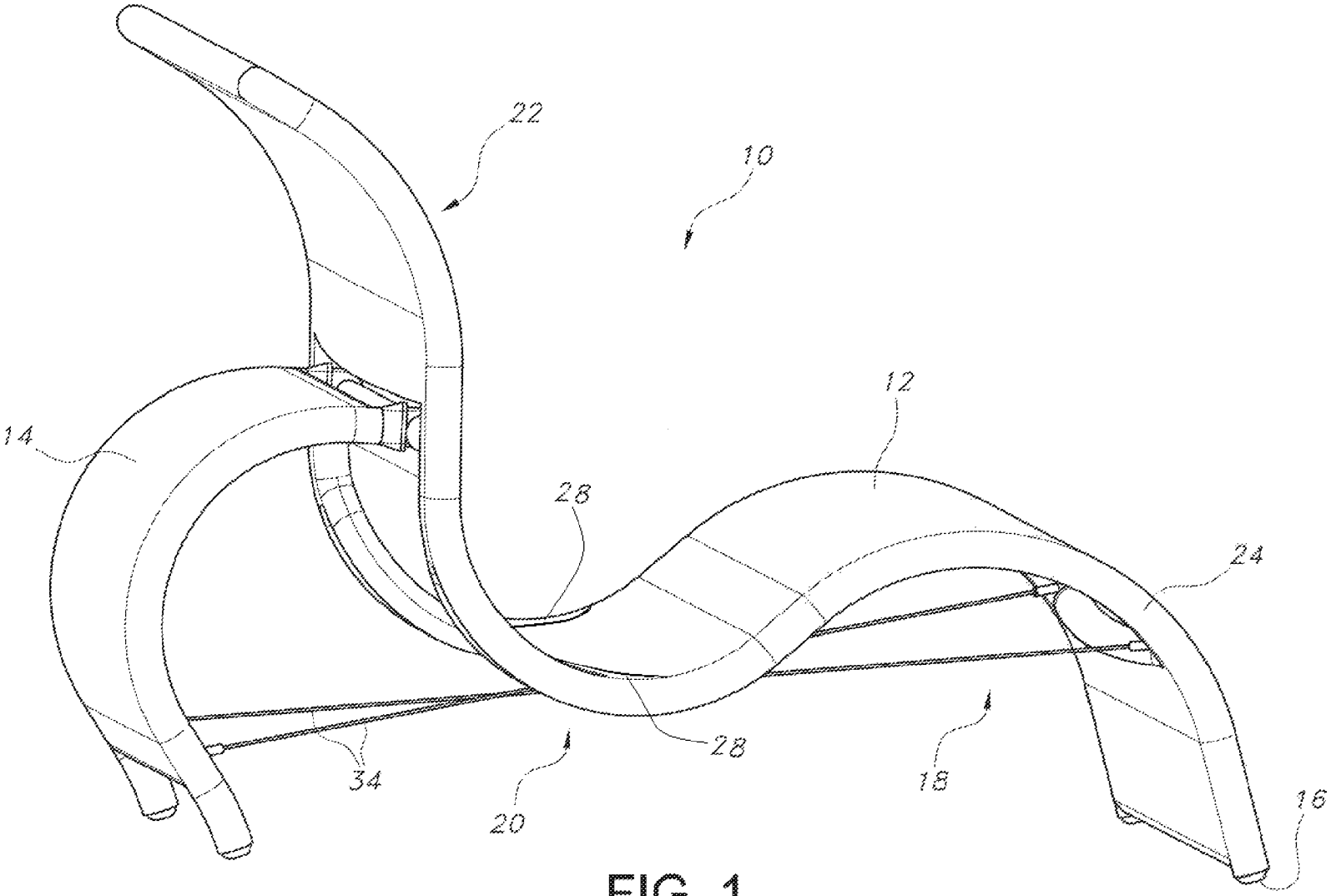
FIG. 1 is a side perspective view of the portable chair of the present invention illustrated in the open position.

Referring to FIG. 1, the portable chair of the present invention is illustrated in the open, seating position. The chair 10 is comprised of a body 12 and a pivotally attached support leg 14. The body 12 is provided as an undulating wave-shaped body. A lower portion 16 of the body provides a ground contacting surface. Preferably, the lower portion of the body includes a pair of feet 26 (FIG. 2) upon which the body contacts the floor. The undulating wave-shaped body comprises a convex lower portion 18 which transitions into a concave mid-section 20 which, in turn, transitions into a convex upper portion 22. The concave mid-section 20 has a curvature which is substantially similar to the convex lower portion 18. The curvature of the convex upper portion 22 is less pronounced than that of the mid-section 20 and lower portion 18. The body 12 and support leg 14 may be made using a tubular aluminum frame 24 (see e.g., FIG. 12) with a plastic weave thereon. In one embodiment, the weave comprises two (2) horizontal threads interlaced with one (1) vertical thread. The invention contemplates that any known weave pattern may be used depending upon the style to be achieved. The frame 24 may also be covered using canvas or any other material suitable to support the weight of a user. Alternatively, the body and support leg may be made from molded plastic, such as by injection molding.

Figure 2:
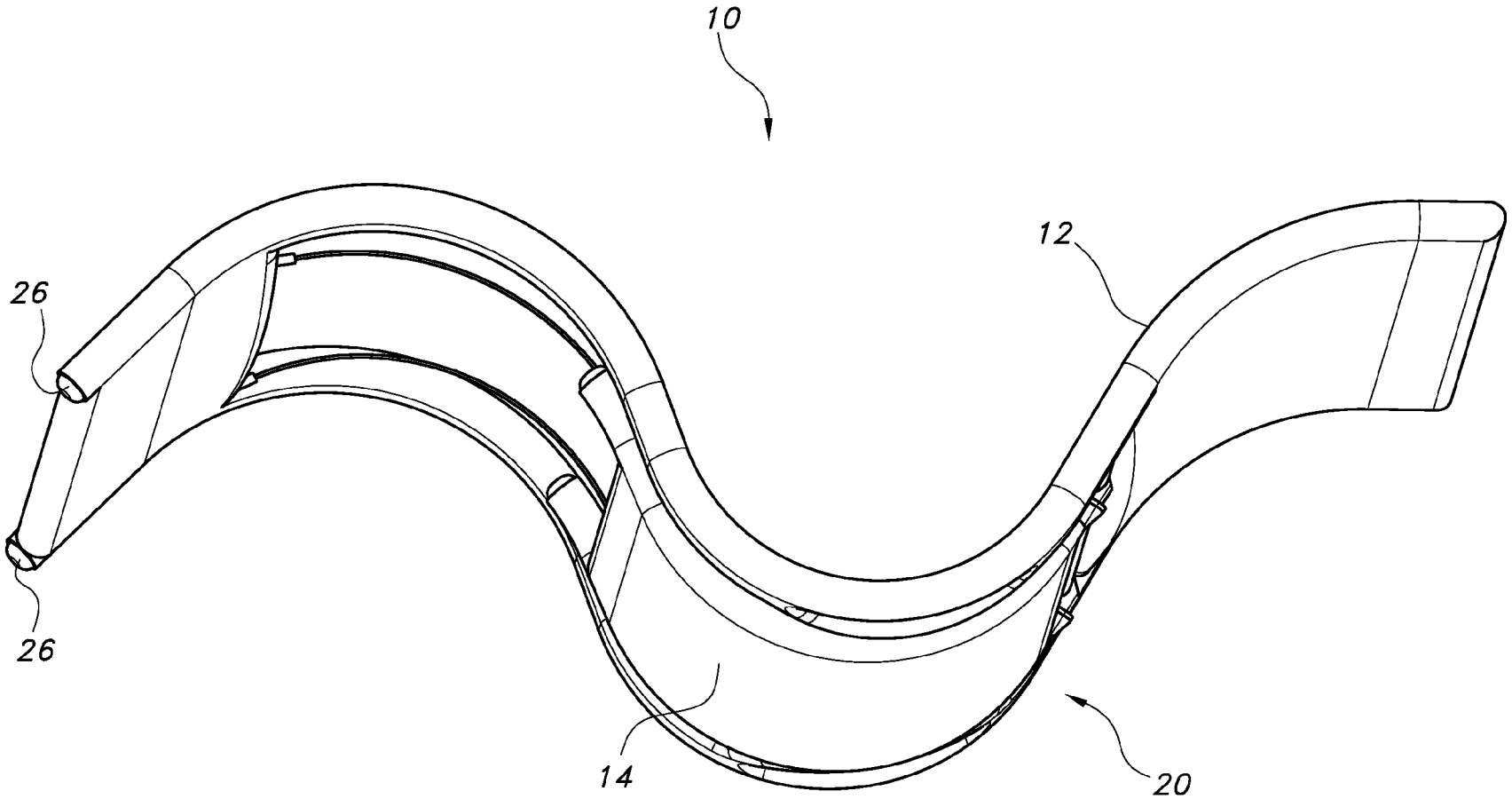
FIG. 2 is a side elevational view of the portable chair of the present invention illustrated in the closed position.
Figure 9:
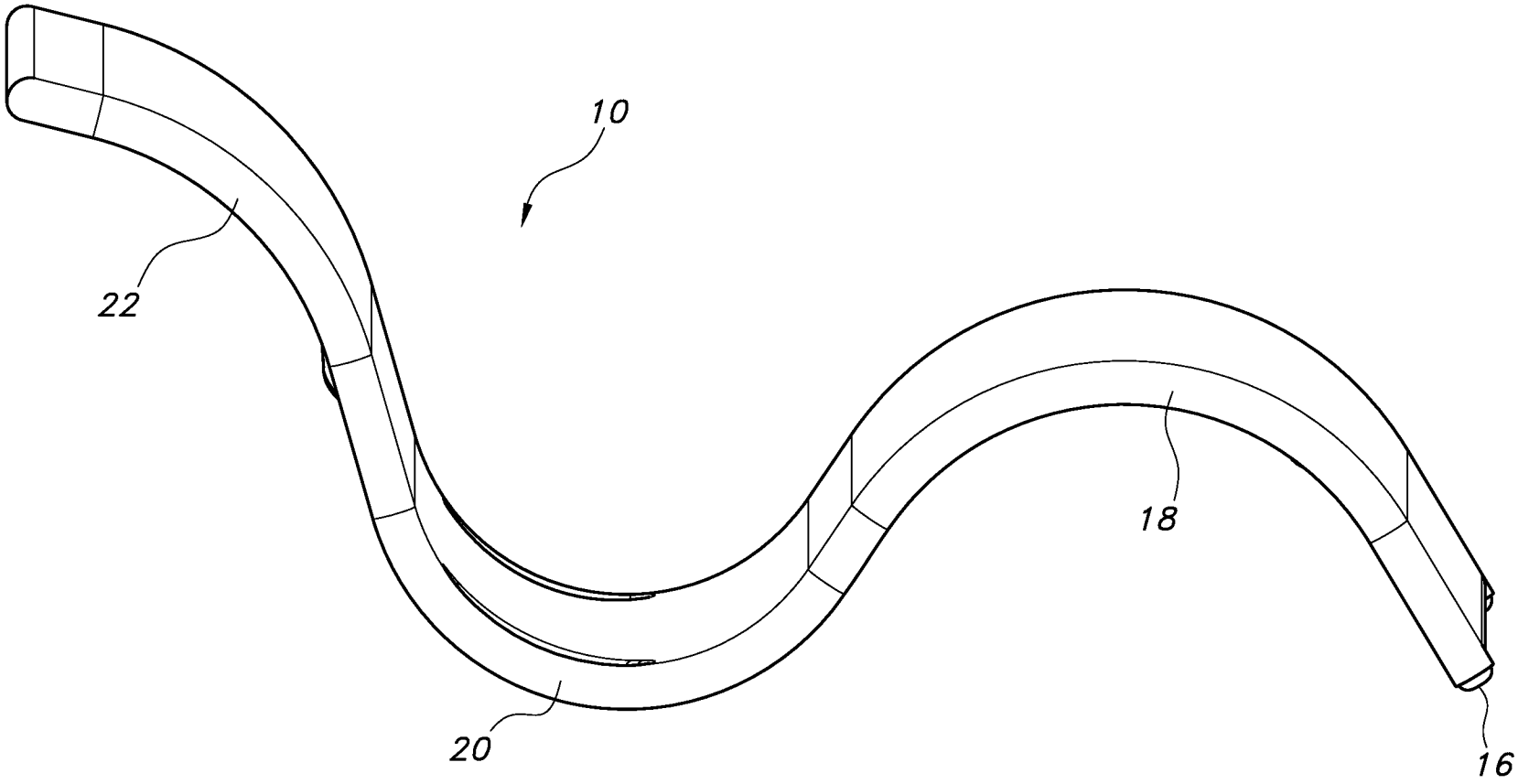
FIG. 9 illustrates a side elevational view of the portable chair of the present invention in a closed position.

The support leg 14 is preferably concave-shaped to closely conform to the shape of the body 12 when in the storage or closed position as shown in FIG. 2. The support leg 14 is movable between an open position suitable for sitting (FIG. 1) and a storage or closed position (FIG. 2) in which the support leg 14 is folded-up into the body 12. In the folded up position, the support leg 14 is nestled between the outer frame members and, as shown in FIG. 9, is not visible from a side view. Thus, with the support leg 14 in the closed position, the chair has a very clean and pleasing appearance. It will be appreciated that the design allows for sitting even when the support leg is in the closed position as shown in FIG. 9. Specifically, due to its unique shape and balance, the chair can be supported on the ground by the feet at the end of the lower body portion 18 and by the mid-section 20 and still be used for seating.

Figure 3:
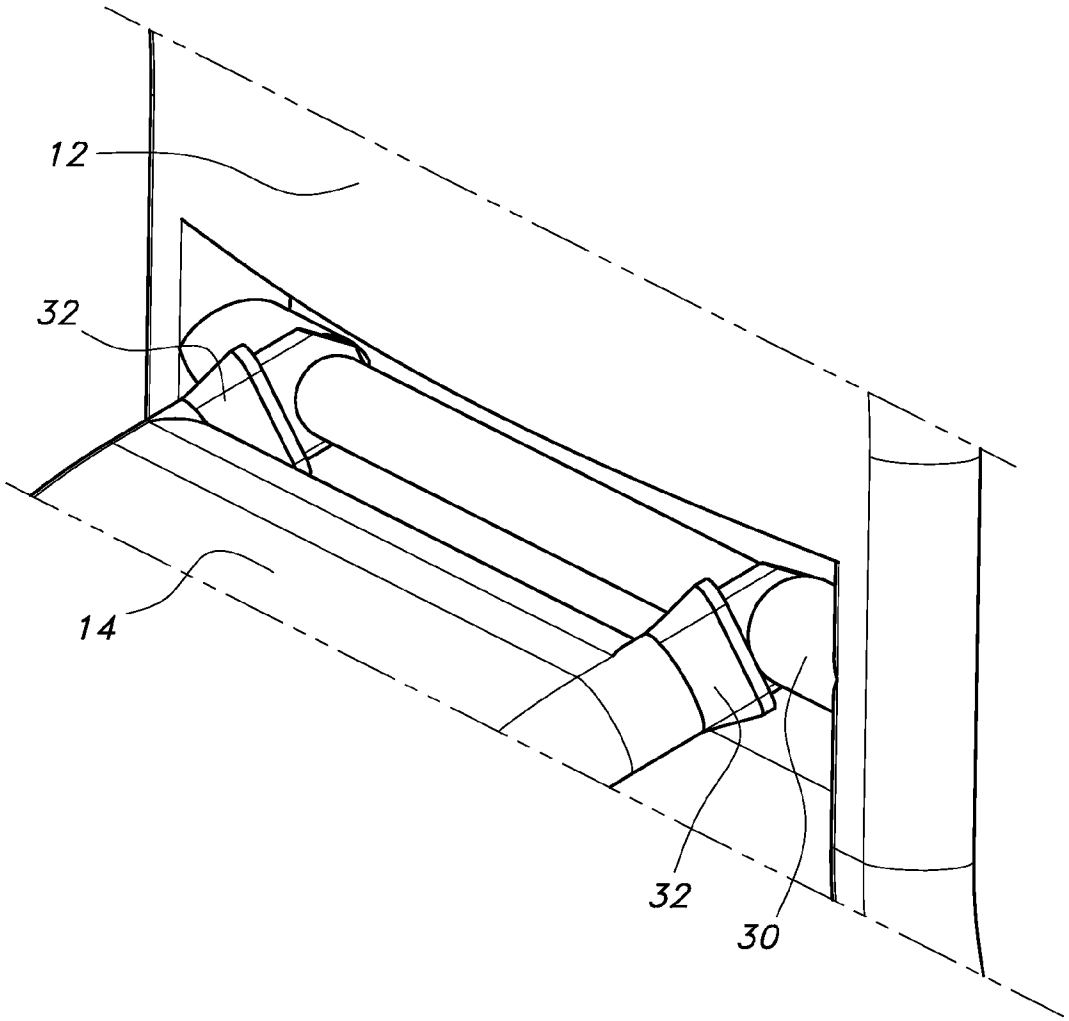
FIG. 3 illustrates the support leg hingedly attached to the chair body.
Figure 4A:
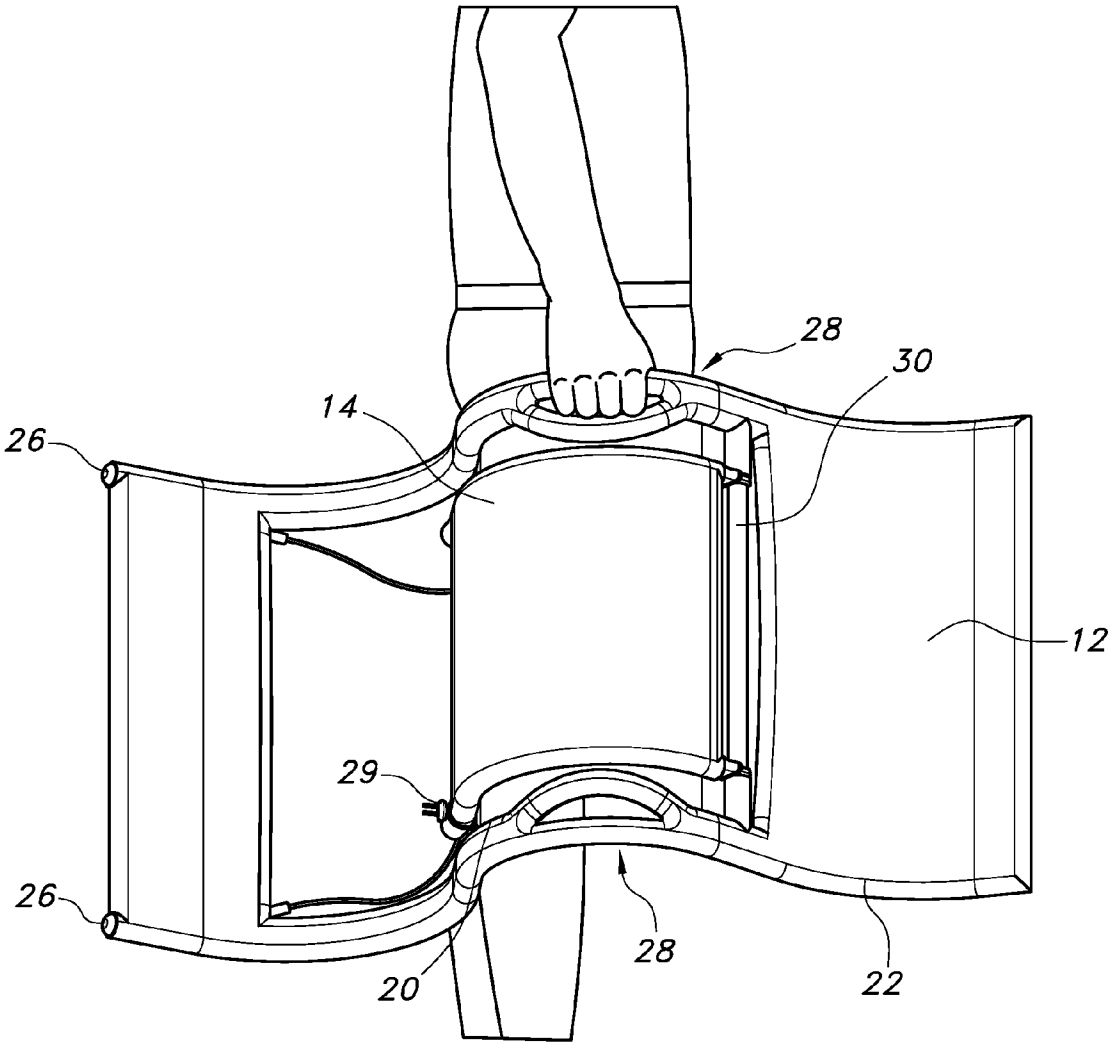
FIGS. 4A and 4B illustrate the portable chair of the present invention in the closed position and being carried by the user.
Figure 4B:
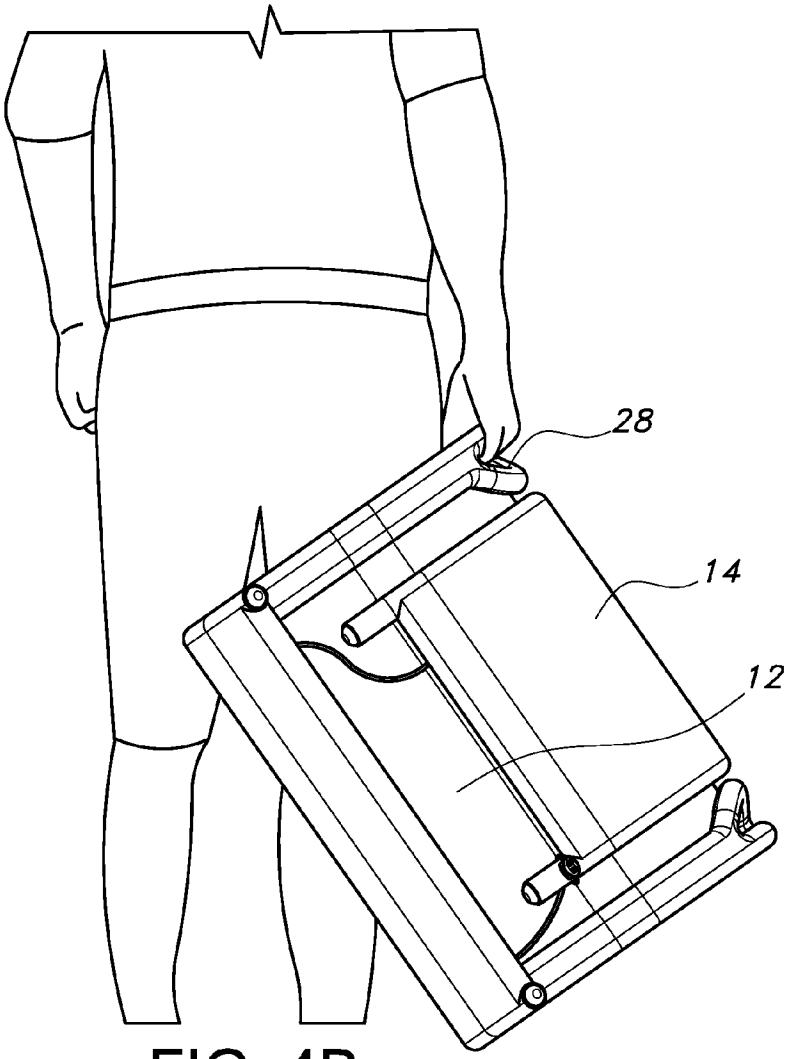
Figure 12:
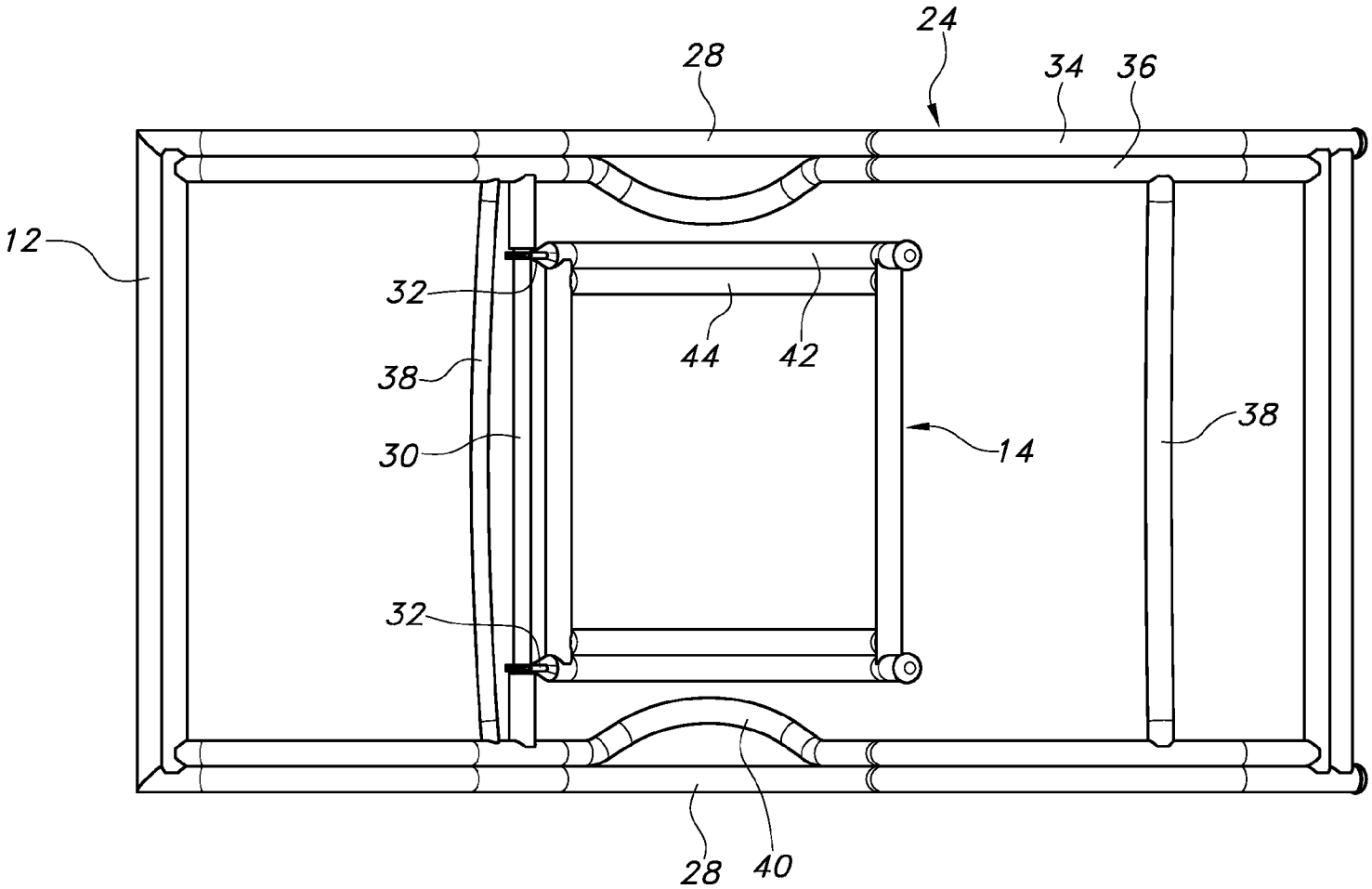
FIG. 12 is a top elevation view of the frame for the portable chair of the present invention.

In the folded-up, closed position, the chair 10 is easily carried by use of a handle 28 having an opening to be easily grasped (see FIGS. 4A and 4B). The support leg 14 is hingedly, pivotably attached to the body 12. Preferably, as shown in FIGS. 3, 4 and 12, the body 12 includes a rod 30 which traverses the body approximately at the transition between the mid-section 20 and the upper portion 22. The support leg 14 includes two spaced apart arms 32 having openings at the ends thereof to receive the rod 30 therethrough allowing the support leg to be moved freely between the open and closed positions. Other types of hinges or pivots which will be apparent to those skilled in the art may also be used to movably couple the support leg 14 to the body 12.

Figure 5:
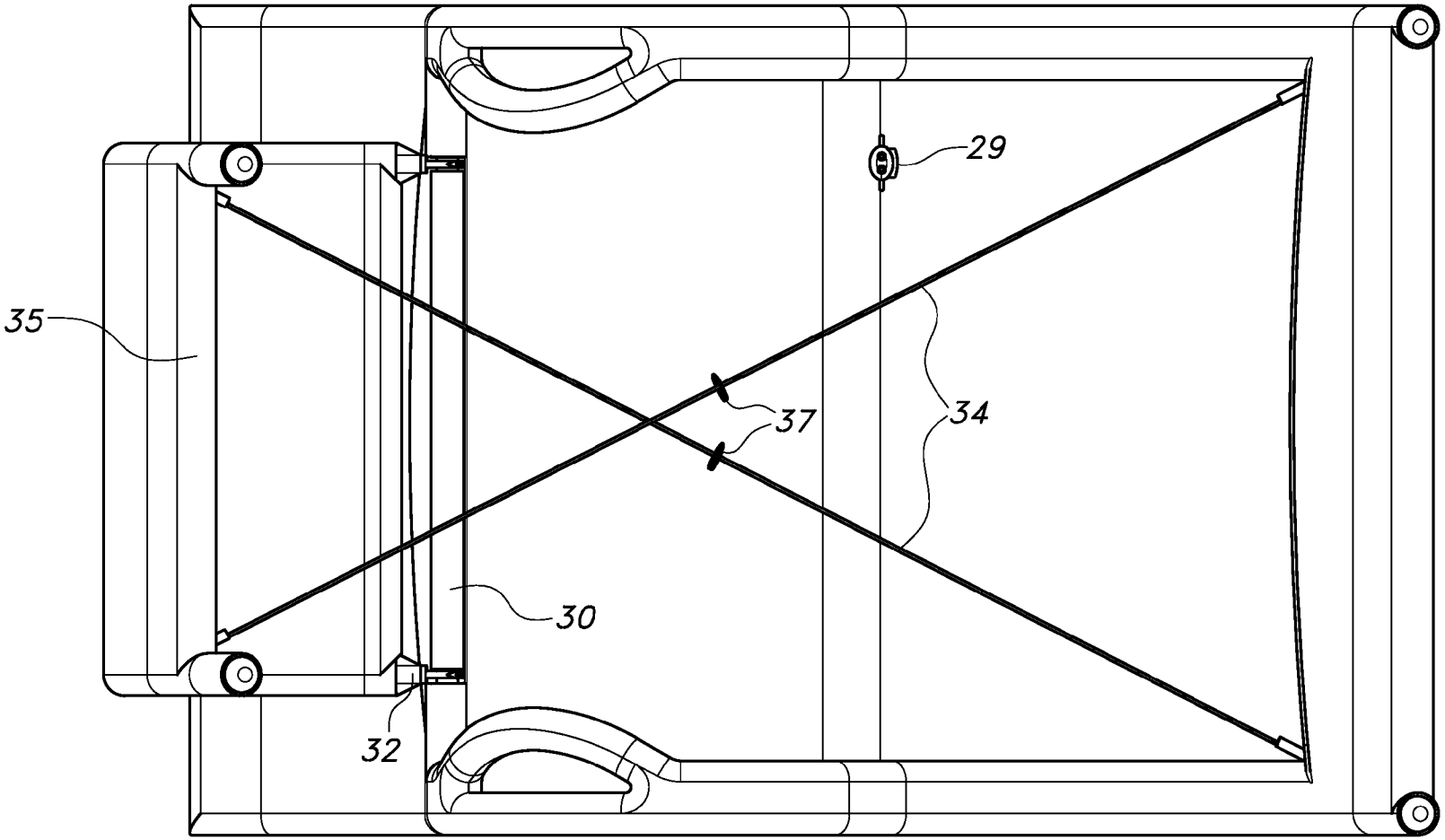
FIG. 5 illustrates the cable system used to maintain the support leg in the open position.

In order to keep the support leg 14 from opening too far, a cable system is provided. Specifically, as shown in FIGS. 1 and 5, at least one cable 34 is mounted to a lower portion of the support leg 14, the other end mounted to the body, preferably near the bottom of the lower portion 18 chair. In a preferred embodiment, a pair of cables 34 are provided and form an x-shaped configuration. The cables are mounted to a lower cross-member 35 of the support leg at one end and to the frame at a lower end of the convex lower portion 18. The cables 34 may also be coupled to the bottom portion of the chair via guides 37 to help maintain the position of the cables 34 close to the chair. The x-shaped cable configuration provides a stable cross frame support underneath the chair and evenly distributes the forces exerted on the frame. The cables 34 also provide the entire chair structure with support against lateral forces. The use of the x-shaped flexible cable configuration does not interfere with the support leg 14 when folded into the closed position so that the support leg 14 can lie substantially flush with the body 12. Since the cable is flexible yet strong, it easily folds itself underneath the support leg 14 in the closed position and does not add any thickness or bulk to the design. Preferably, the cable 34 is made of stainless steel or galvanized steel wire which provides cable strength far exceeding the load requirements for the chair and is also anti-corrosive. Alternatively, as will be appreciated by those skilled in the art, the x-shaped configuration may be replaced with cables being substantially parallel. Furthermore, the cable may be replaced with other suitable materials such as high-strength rope, straps, a chain or the like.

As shown in FIGS. 1 and 2, the undulating wave-shaped body 12 gives the chair a unique and instantly recognizable appearance and style. While being aesthetically pleasing, the undulating wave-shaped body also provides a comfortable seating angle and pitch for persons of different body sizes, including adults and children. The shape of the body 12 also contributes to the ease of transporting the chair. Specifically, the handles 28 for carrying the chair are positioned offset from the bottom of the concave mid-section 20 curve. As shown in FIGS. 4A and 4B, the curve of the chair creates an off-balance tilt when carrying the chair by the handle 28 so that the chair stays clear from the users legs. (See FIGS. 4A and 4B). Also, when being carried, the mid-section 20 curve hugs the carrier's body without causing the chair to hit the users legs while walking. As shown in FIG. 4A, to ensure that the support leg 14 does not open during transportation, a latch 29 is provided to hold the support leg 14. The latch may be a tether in the form of a loop connected to the chair which slides over one of the ends of the arms 32 to hold the support leg. Other types of latches may be used such as clips, hooks, sockets or any other latch known to those of ordinary skill in the art.

Figure 6:
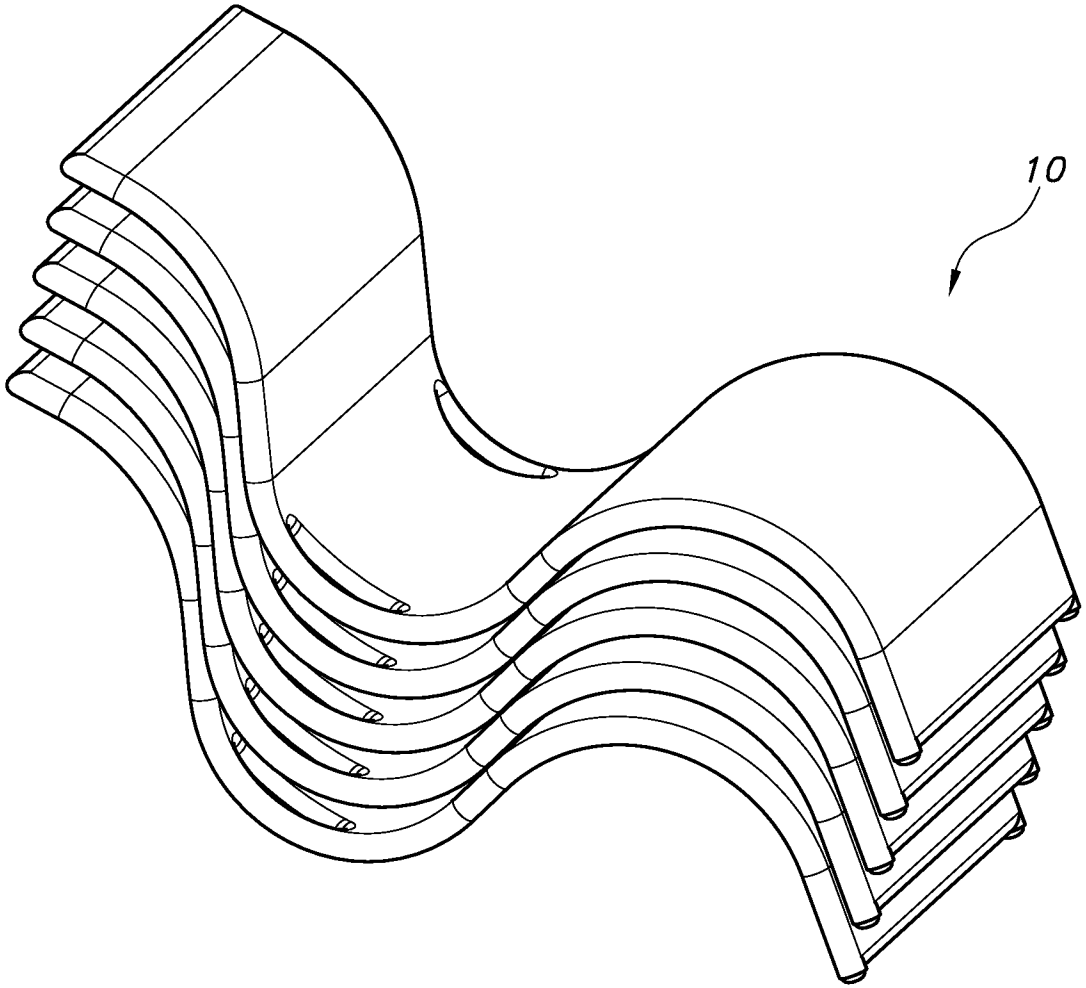
FIG. 6 illustrates a plurality of portable chairs made in accordance with the present invention in a closed position and stacked for storage.
Figure 7:
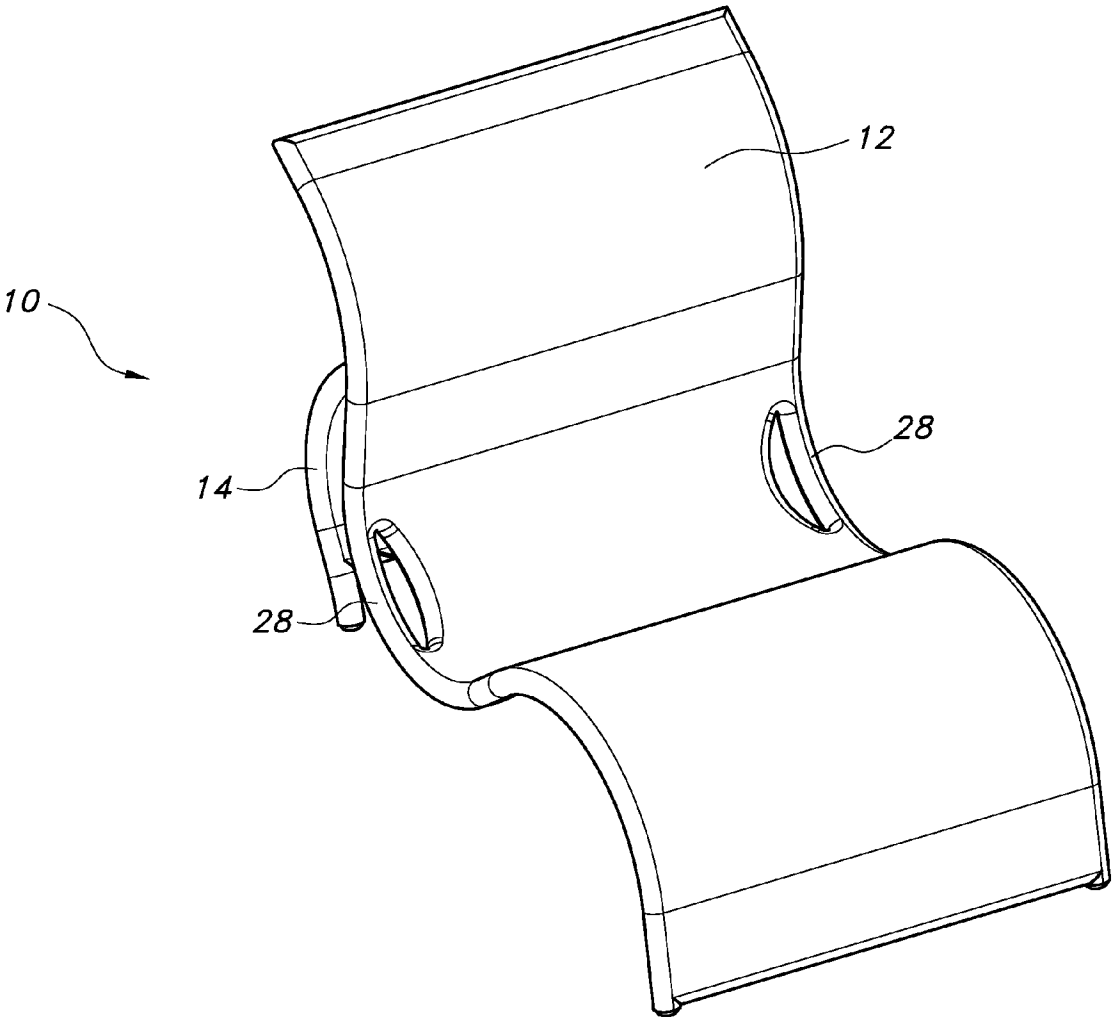
FIG. 7 illustrates a top perspective view of the portable chair of the present invention.
Figure 8:
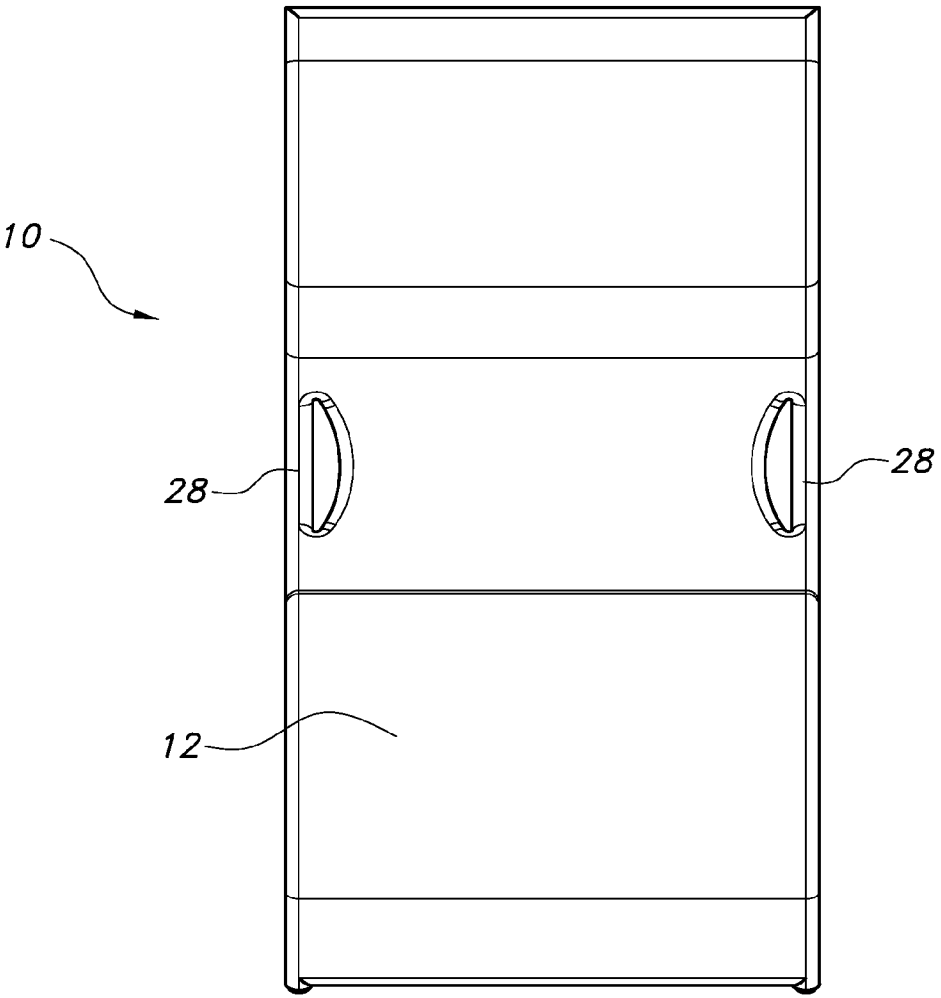
FIG. 8 illustrates a front view of the portable chair of the present invention.

Another advantage of the portable chair design of the present invention is the ability to stack a plurality of chairs in the storage or closed position. As previously discussed, the support leg 14 folds up and follows the contour of the body as shown in FIG. 2 making the chairs easily stackable. FIG. 6 illustrates five (5) chairs made in accordance with the present invention stacked for storage. The contour of one chair easily stacks into the contour of the chair below. Furthermore, the hand holds or handles 28 make the chair easy to stack and unstack.

The handles 28 are provided to be wide enough and comfortable to grip for nearly all sizes of hands. Providing handles 28 on both sides of the chair makes it easy to carry for both right-handed and left-handed users. The handles 28 also provide a place for the user to hold onto the chair when sitting down or getting up from the seated position. As discussed previously, the handles 28 are strategically placed near but slightly offset from the center of the concave mid-section 20 curve to help balance the weight of the chair evenly when being carried.

Figure 10:
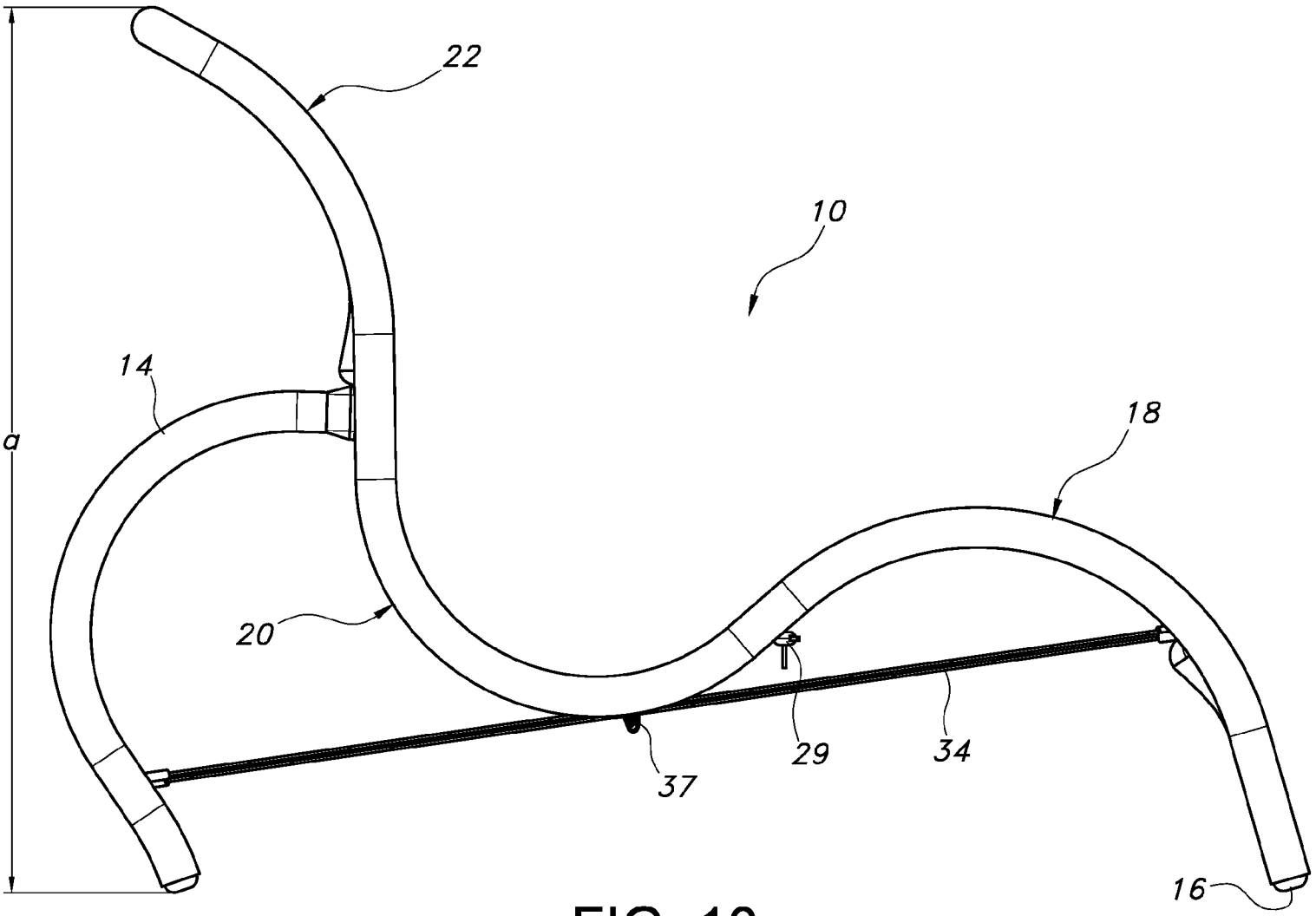
FIG. 10 illustrates the compact nature of the portable chair of the present invention.
Figure 11:
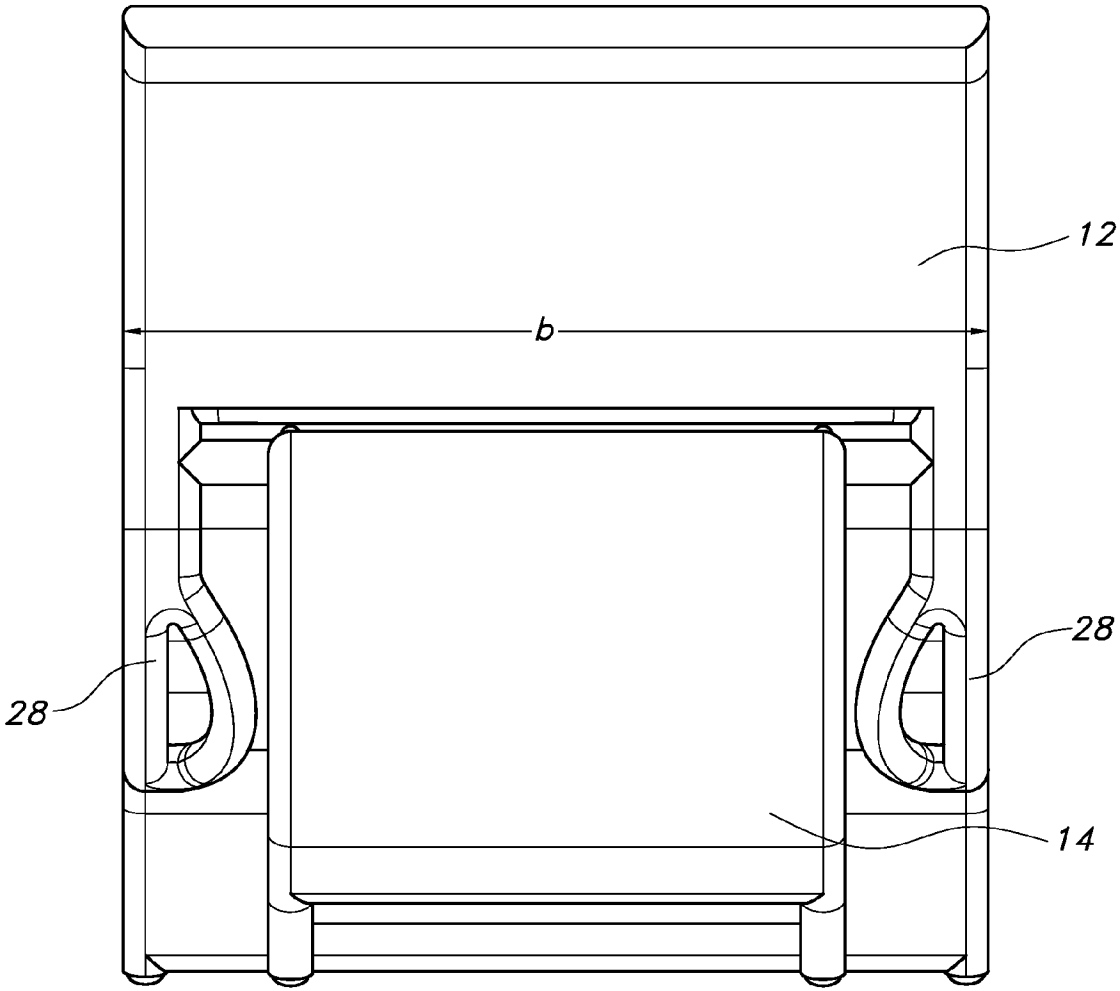
FIG. 11 further illustrates the compact nature of the portable chair of the present invention.

The portable chair of the present invention is compact, lightweight, easy to carry and stackable for storage purposes. As shown in FIG. 10, the chair has a height measured from the floor to the top of the chair, illustrated as dimension "a" in FIG. 10 of approximately 23 inches. Referring to FIG. 11, the chair has a width, illustrated as dimension "b" in FIG. 11 of approximately 19 inches. Those skilled in the art will appreciate that such dimensions may be modified to suit a particular need or desire. As previously discussed, although dimensionally being compact, the chair is suitable for use by both adults and children. Due to its compact and lightweight design, as well as its ease of portability, the chair of the present invention is well suited as a beach chair. Furthermore, the portable chair of the present invention has a unique undulating wave-shaped body which is both stylish and functional. Accordingly, it is clear from the above description that the objects of the invention have been fulfilled.

FIG. 12 illustrates the frame assembly for a chair made in accordance with the present invention. As shown in FIG. 12, the frame assembly 24 may be made from tubular aluminum welded into a substantially one-piece, unitary structure which is lightweight and extremely durable. As illustrated in FIG. 12, the frame 24 includes an outer frame 34 and inner frame 36 welded together. The inner frame also includes a plurality of cross-members 38 which traverse the frame for added strength. Furthermore, the inner frame includes a crescent shaped bend 40 to form the handles 28 for the chair. The support leg 14 also includes a dual tube frame 42, 44 construction for the curved section on the support leg.

Those skilled in the art will appreciate that the conception, upon which the disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

What is claimed is:

1. A chair comprising:

an undulating wave-shaped molded plastic body that is a continuous one-piece element or a continuous rigid element having a lower portion which includes a ground-contacting surface, wherein the undulating wave-shaped body includes an upwardly convex lower portion which transitions into an upwardly concave mid-section which transitions into an upwardly convex upper portion; and a support leg having a lower portion having a ground contacting surface, wherein an upper portion of the support leg is pivotally-attached to the body and movable between a closed position and an open position, the support leg being adjacent an underside of the body and being concave-shaped in an upward direction to match in shape and dimension a shape of the body when the support leg is in the closed position.

2. The chair of claim 1, wherein the body includes at least one handle positioned on the concave mid-section.

3. The chair of claim 1, wherein the body and support leg are formed by injection molding.

4. The chair of claim 1, further comprising at least one cable having one end attached to the lower portion of the support leg and the other end attached to the body to maintain the support leg in the open position.

5. The chair of claim 4, wherein the at least one cable comprises two cables mounted in an x-shape.

6. The chair of claim 1, wherein a plurality of chairs is stackable when the support legs are in the closed position.

7. The chair of claim 1, wherein the undulating wave-shaped body includes the concave mid-section having a pair of handles, the support leg being positioned between the handles when in the closed position.

8. The chair of claim 1, wherein the ground contacting surfaces on the body and support leg include feet thereon.

9. The chair of claim 1, wherein the body includes a transversely mounted rod in the mid-section or the upper portion and the support leg includes two spaced apart arms with openings to receive the rod to allow the support leg to move between the closed position and the open position.

10. The chair of claim 2, wherein the curvature of the chair creates an off-balance tilt when carrying the chair by the handle so that the chair stays clear of the legs of a person carrying the chair.

11. The chair of claim 2, wherein when holding the chair by the handle, a person is positioned within the concave mid-section of the body.

12. The chair of claim 1, further comprising a latch to maintain the support leg in the closed position.

* * * * *